United States Patent [19]

Mason

[11] Patent Number: 4,743,307

[45] **Date of Patent: * May 10, 1988**

[54] APPARATUS FOR PROCESSING SUGAR CANE

[76] Inventor: William Mason, 16103-86 Ave., Edmonton, Canada

[ * ] Notice: The portion of the term of this patent subsequent to Feb. 25, 2003 has been disclaimed.

[21] Appl. No.: 832,353

[22] Filed: Feb. 24, 1986

Related U.S. Application Data

[63] Continuation of Ser. No. 565,612, Dec. 27, 1983, Pat. No. 4,572,741, which is a continuation of Ser. No. 295,092, Aug. 21, 1981, abandoned.

[51] Int. Cl.[4] ..... C13C 1/04; B26D 1/12

[52] U.S. Cl. ..... 127/2; 407/52; 407/50; 407/49; 407/41; 144/230; 241/294

[58] Field of Search ..... 241/294, 195, 101.4, 241/81, 2; 127/42; 99/538, 540-542, 544, 567, 623-625; 407/50, 49, 41, 52; 144/230

[56] References Cited

U.S. PATENT DOCUMENTS

| | | | |
|---|---|---|---|
| 447,900 | 3/1891 | Pallen | 407/50 |
| 534,220 | 2/1895 | Kent | 407/50 |
| 960,526 | 6/1910 | Erlandsen | 407/50 |
| 990,068 | 4/1911 | Searles | 407/50 |
| 1,318,950 | 10/1919 | Allison | 241/294 |
| 1,422,988 | 9/1922 | Kienzl | 407/50 |
| 1,460,029 | 6/1923 | Mattson | 407/50 |
| 1,516,172 | 11/1924 | Berg | 407/50 |
| 1,714,700 | 5/1929 | Stull | 407/50 |
| 1,778,650 | 10/1930 | Weir | 241/294 |
| 2,807,989 | 10/1957 | Schaan et al. | 241/294 |
| 2,810,189 | 10/1957 | See et al. | 407/50 |
| 4,572,741 | 2/1986 | Mason | 127/2 |

*Primary Examiner*—Helen M. S. Sneed
*Assistant Examiner*—Chung K. Pak
*Attorney, Agent, or Firm*—Harold H. Dutton, Jr.; George H. Dunsmuir

[57] ABSTRACT

Sugar cane is processed using an apparatus, which includes an input end with a comb back conveyor for controlling the quantity of cane passing to the remainder of the apparatus; an aligning; first cleaning and thin out section, where randomly oriented cane stalks are aligned and foreign bodies, especially stones and ferrous objects are removed from the cane; a billeting or cutting section for cutting the stalks into billets; a second cleaning section in the form of a cleaning tower in which vertically moving air is used to remove leaves, dust and any other trash from the flow of cane; a chute and pivotally mounted swing conveyor for distributing cane billets in an elongated, partitioned distributing hopper; a surge elimination chute; a billet aligner and delivery unit for delivering cane billets to a plurality of separators for separating the epidermis from the cane billets and separating the rind from the core; and a discharge section, including conveyors for discharging the separated material from the apparatus.

4 Claims, 16 Drawing Sheets

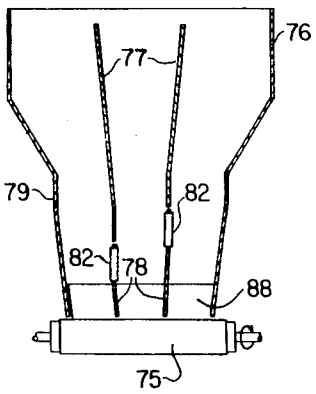
FIG. 10
FIG. 11
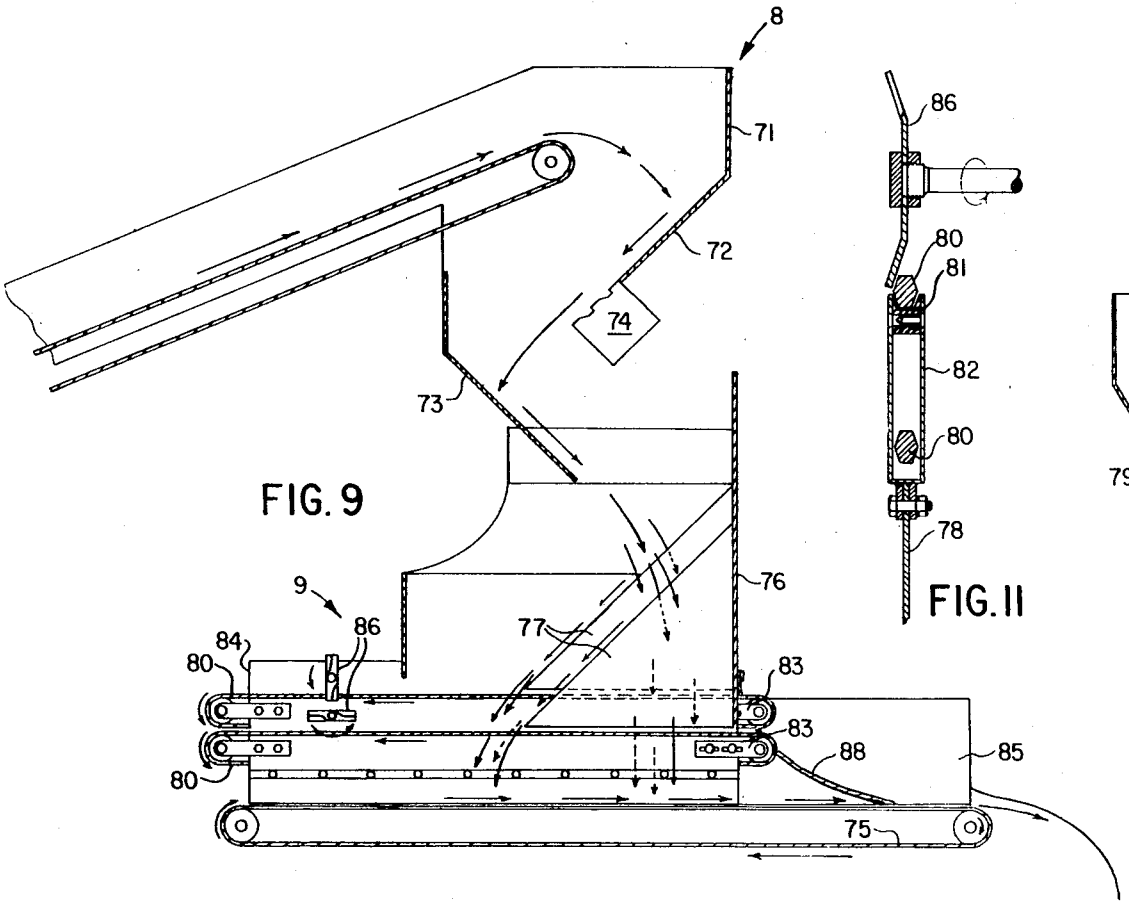
FIG. 9

APPARATUS FOR PROCESSING SUGAR CANE

CROSS REFERENCE TO RELATED APPLICATION

This application is a continuation of my copending application Ser. No. 06/565,612 filed Dec. 27, 1983, now U.S. Pat. No. 4,572,741 issued Feb. 25, 1986, which in turn is a continuation of application Ser. No. 295,092 filed Aug. 21, 1981, and now abandoned.

BACKGROUND OF THE INVENTION

1. Field of the Invention

This invention relates to a method and apparatus for processing sugar cane and in particular to an apparatus and method of processing sugar cane stalks.

A sugar cane stalk consists of a film of wax on an epidermis material which covers a harder casing material called the rind, and a core enclosed by the rind. The core is a softer fibrovascular material and juices. All elements of the stalk, except the wax hold juices in varying quantities and composition, with the core holding the major portion of the sugar juices, as well as the fibrovascular material consisting of soft fibres and a cell-like material, which, when dried, forms a pith-like material.

2. Discussion of the Prior Art

The problem involved in the processing a sugar cane are (i) orientation of the stalks, (ii) cleaning of the stalks and (iii) milling of the stalks, i.e., separating of the elements of the stalks to obtain the sugar juices. These problems are solved with varying degrees of success by methods and apparatus disclosed, for example, in U.S. Pat. Nos. 3,566,944; 3,657,510; and 3,567,511, all issued to S. E. Tilby on Mar. 2, 1971, and 3,976,498, issued to S. E. Tilby et al on Aug. 24, 1976.

SUMMARY OF THE INVENTION

The object of the present invention is at least partially to solve the problems encountered with the devices disclosed by the above mentioned art and by the patents mentioned therein by providing a method and an apparatus which enable the relatively efficient bulk handling of sugar cane on a large commercial scale.

Accordingly, the present invention relates to an apparatus for processing sugar cane comprising:

(a) an inlet station for receiving randomly oriented cane stalks;
(b) a feed control station for controlling the quantity of cane stalks fed to the remainder of the apparatus;
(c) an aligning station for making a first alignment of said cane stalks;
(d) cutter means for cutting said cane stalks into billets;
(e) cleaning means for cleaning said billets;
(f) hopper means for receiving said billets;
(g) billet aligner and delivery means for aligning said billets for subsequent processing; and
(h) separator means for separating the cane into epidermis, rind and pith components.

The invention also relates to a method of processing sugar cane comprising the steps of:

(a) introducing randomly oriented cane stalks into a processing apparatus;
(b) controlling the quantity of stalks fed to the remainder of the apparatus;

(c) aligning said stalks, whereby the longitudinal axis of the stalks are aligned in substantially the same direction;
(d) cutting said stalks into billets;
(e) cleaning said billets; and
(g) separating said billets into epidermis, rind and pith components.

The apparatus and method described above meter, thin out and align sugar cane stalks prior to chopping of the stalks into billets. Foreign matter, leaves and cane stools are separated from the stalks as part of the cleaning step in the process. Some of the important features of the invention are the uniform flow of cane stalks or billets, the elimination of surges of cane billets to aligning and separation units, and the efficient cleaning of the stalks. By cleaning is meant the separation of extraneous material such as stones, metal, dirt and other debris and the washing of the cane stalks to remove sand or mud therefrom.

The following are significant features of the invention described and claimed herein.

At the inlet end of the apparatus, cane stalks are fed to an inclined conveyor and during passage along such conveyor, are engaged by a comb back conveyor, i.e., a conveyor including tines or fingers extending outwardly from its flights. The comb back conveyor moves in a direction opposite to the direction of travel of the stalks on the inclined conveyor. By adjusting the gap between the comb back conveyor and the inclined conveyor, the quantity of cane passing to the remainder of the apparatus is metered.

After leaving the inclined conveyor, the randomly oriented cane stalks are aligned by allowing them to fall into a chute, one side of which is vertical and the other side of which is inclined, so that the cane stalks slide down the sloped side of the chute to a conveyor, thereby becoming aligned.

At this point, some foreign bodies, and in particular stones and ferrous objects are removed from the cane by passing the cane over a gap between two conveyors, the leading end of the second of which is lower than the trailing end of the first conveyor. The gap between the conveyors is substantially greater than the anticipated trajectory of foreign objects such as stones, so that the objects drop from the cane flow. By making the roller at the trailing end of the first conveyor magnetic, some metal objects can be removed from the cane flow.

The cane stalks are cut into sections or billets, which are caused to move down an inclined slide while air is blown vertically through the cane to remove leaves, dust and other extraneous material from the cane.

The prevention of the formation of tunnels through the billets and the resulting lowering or stopping of cane flow is achieved by means of an elongated hopper, and a swing conveyor is provided for feeding the billets to such hopper. The hopper is provided with a plurality of drag chains, and is designed in such a manner that tunnelling does not occur, as is often the case with a hopper having a V-shaped bottom. The hopper includes vertical divider plates or partitions, and walls inclined in such a manner as to ensure movement of the cane billets downwardly onto the drag chain conveyors.

Before reaching the separators, the cane billets are distributed and metered, and surges in the quantity of cane delivered to each separator is eliminated by feeding the cane billets to a cascade of sloping plates, one of which pours the cane billets onto another sloped plate to spread the cane heaps delivered by the hopper drag chain flights.

Finally, the cane billets are fed to a final alignment and delivery unit for feeding into separators. During charging of the separators, the cane billets travel through arcuate chutes containing a perforated plate or grill followed by a set of permanent magnets. Air is blown through the grill across the path of travel of the cane billets to effect a final cleaning. The magnets provide a final protection against the introduction of iron objects into the separators. During this stage of the operation, the cane billets can be diverted away from the separators to prevent overloading of the separators. Any diverted cane billets are recirculated, i.e., returned to the portion of the apparatus immediately preceding the cleaning tower.

In the apparatus of the present invention, all belt drives may be replaced by chains and gears. Moreover, the core milling drums used in the separators may be driven directly from a power source which eliminates power loss encountered when using an indirect drive. The complete power transmission system of the invention is enclosed, which facilitates adequate lubrication while preventing wear producing contamination. Such an arrangement permits higher operating speeds and results in a minimum of maintenance. By using flywheels mounted on the shafts of the core milling drums in the transmission, the normally fluctuating loads on the core milling drums and drives are smoothed out.

In the separators, rind material is diverted away from the exit of the nip between the milling and feed drums, and the direction of the flow of such rind is controlled. Thus, the core material is permitted to expand and travel away from the nip between the milling and feed drums which reduces the load on the milling drum caused by back pressure of core material, as is the case when the core material is diverted.

BRIEF DESCRIPTION OF THE DRAWINGS

The invention will now be described in greater detail with reference to the accompanying drawings, which illustrate a preferred embodiment of the invention, and wherein:

Note: All views of the accompanying drawings are schematic. For the sake of brevity and easy reading, the word "schematic" has been omitted in the description of the Figures. In the drawings, for the most part, the expression "longitudinal section" is intended to mean a sectional view taken in a plane incorporating the longitudinal axis of an element, and by "cross-sectional" is meant a sectional view in a plane perpendicular to the longitudinal axis of the element. In general, for individual elements, the proper terms are used, particular with respect to FIGS. 15 to 26.

FIG. 9 is a longitudinal sectional view of a surge prevention chute and the billet aligner of FIG. 8;

FIG. 10 is a cross-sectional view of the leading end of the billet aligner of FIGS. 8 and 9;

FIG. 11 is a cross-sectional view of the billet aligner of FIGS. 8 to 10 near the leading end thereof;

(Note: Except for FIG. 27, the remaining Figures of the drawings illustrate elements of the separator of FIG. 13).

Figure 14:
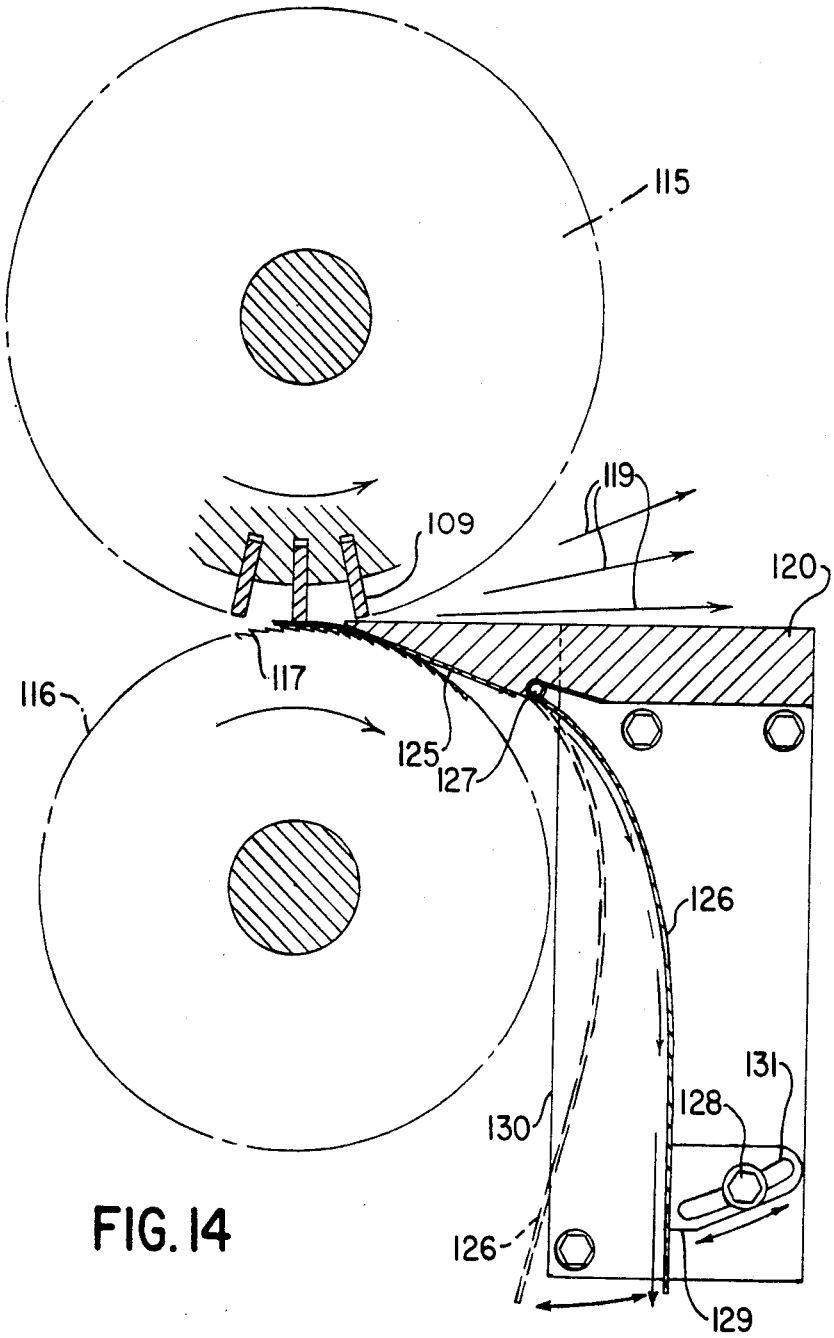
Figure 15:
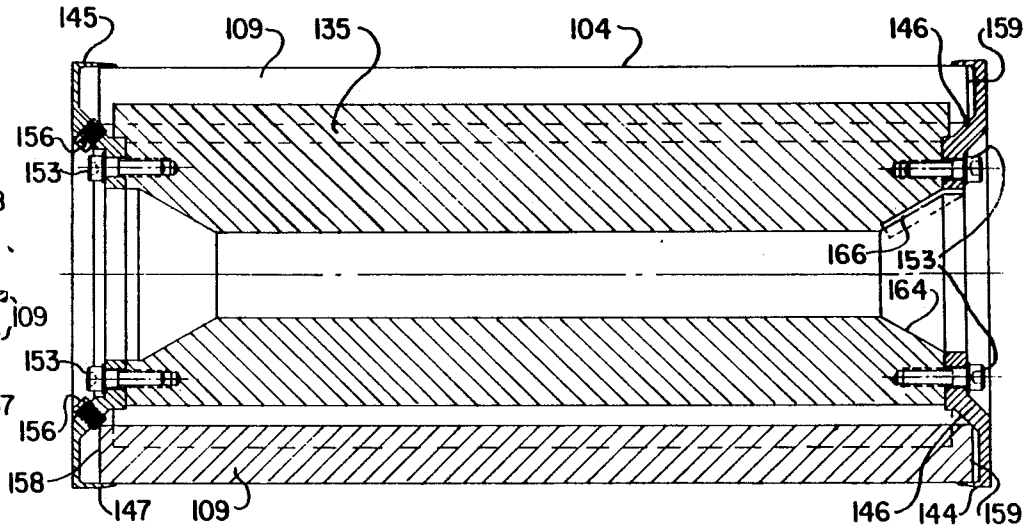
Figure 16:
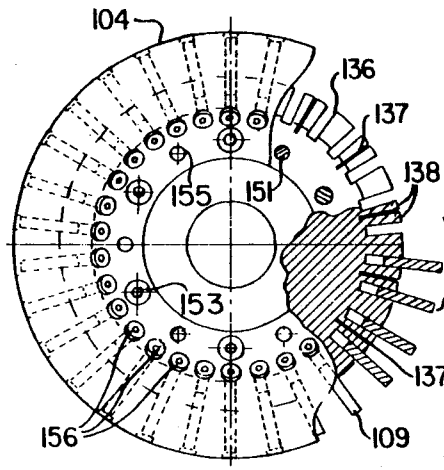
Figure 18:
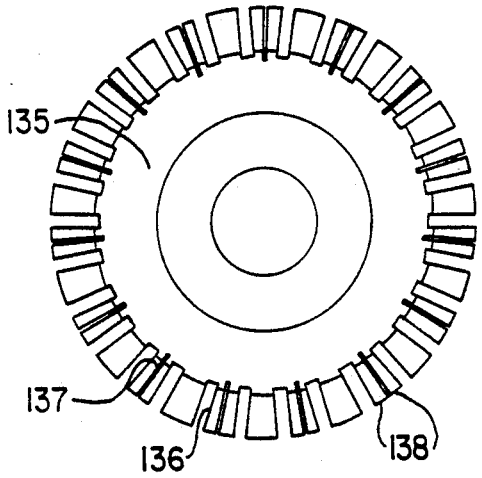
Figure 20:
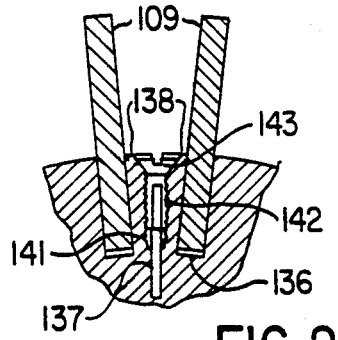
Figure 17:
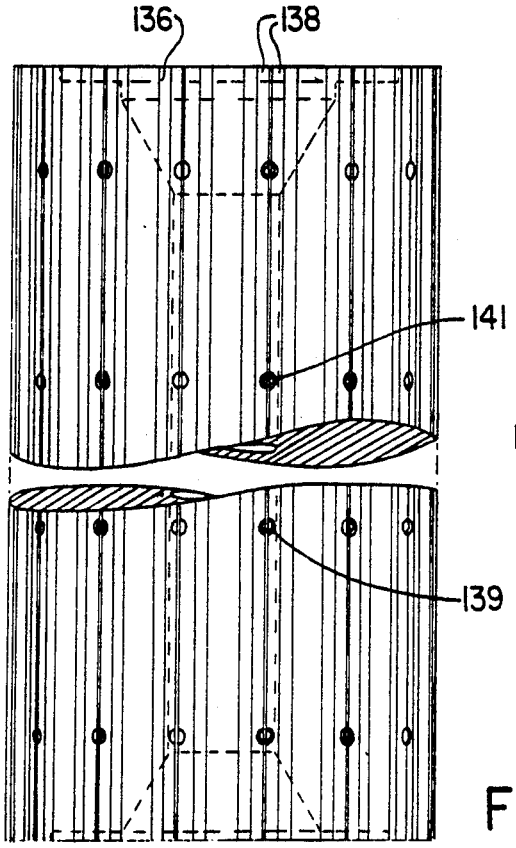
Figure 19:
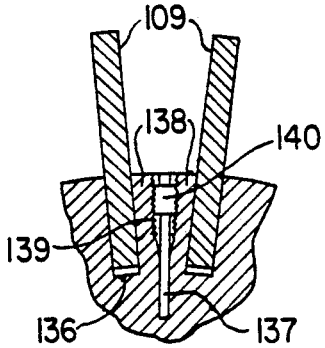
Figure 23:
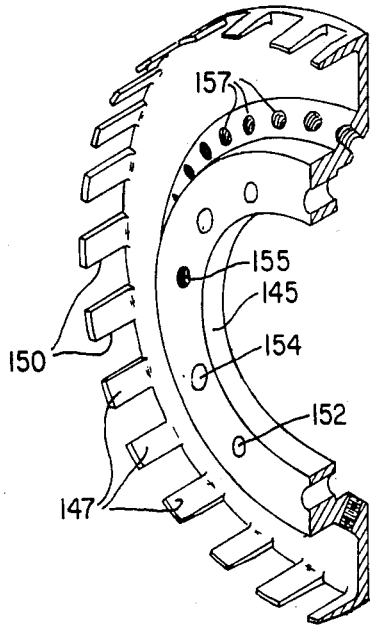
Figure 21:
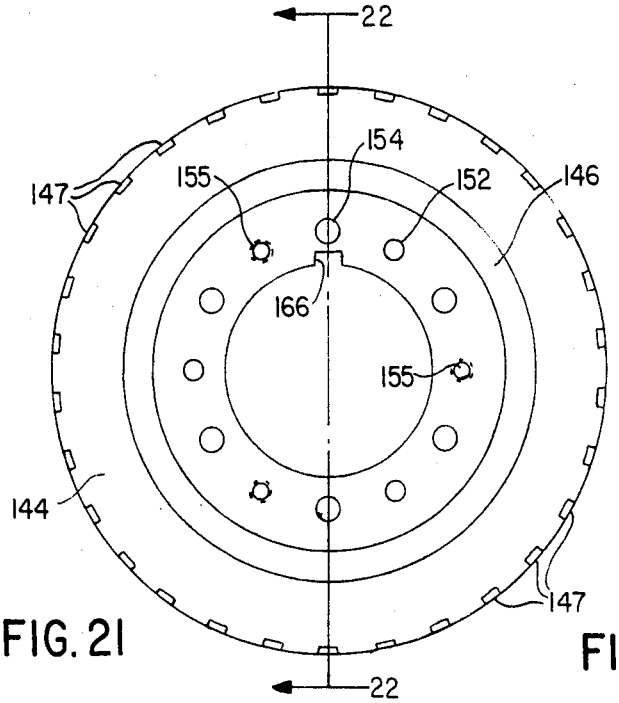
Figure 22:
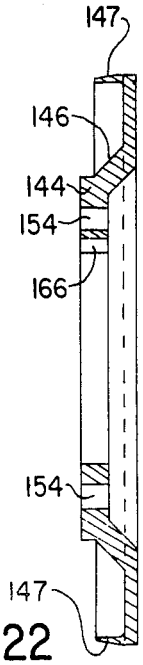
Figure 26:
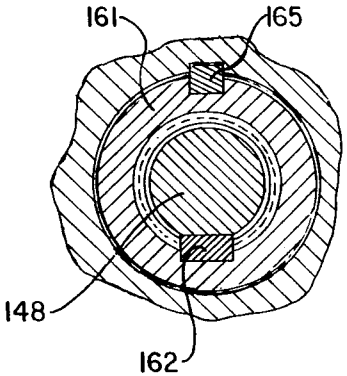
Figure 24:
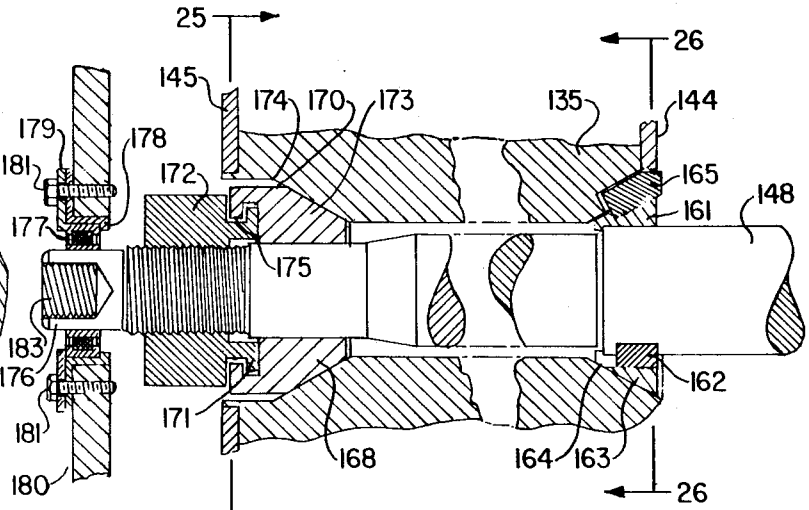
Figure 25:
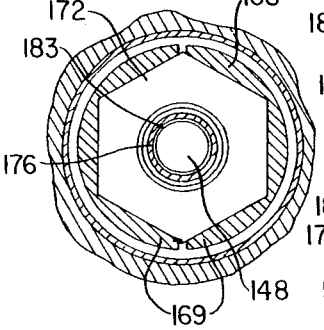
Figure 27:
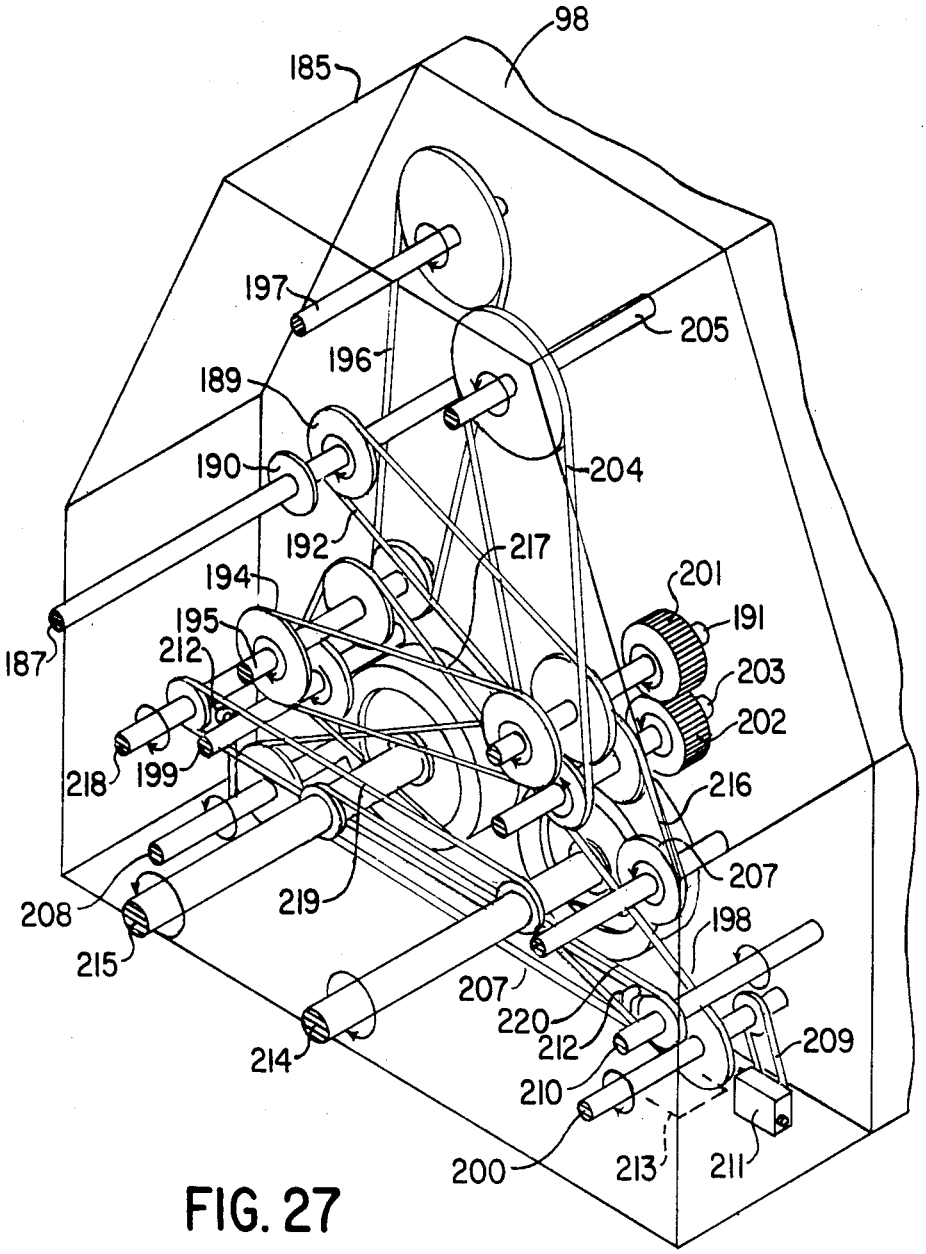

FIG. 14 is a longitudinal section of a rind deflector and guide plate;

FIG. 15 is a longitudinal sectional view of a milling drum;

FIG. 16 is a partly sectioned, end view of the drum of FIG. 15;

FIG. 17 is a plan view of the body of the milling drum of FIGS. 15 and 16;

FIG. 18 is an end view of the body of FIG. 17;

FIGS. 19 and 20 are cross sections of portions of the periphery of the milling drum of FIGS. 15 to 18;

FIG. 21 is an end view of one end plate for use on the drum of FIGS. 15 to 20;

FIG. 22 is a cross section taken generally along line 22—22 of FIG. 21;

FIG. 23 is a perspective cross-sectional view of another end plate for use on the drum of FIGS. 15 to 20;

FIG. 24 is a longitudinal sectional view of a milling or feed drum mounting arrangement;

FIGS. 25 and 26 are cross-sectional views taken generally along lines 25—25, and 26—26, respectively of FIG. 24; and FIG. 27 is a perspective view of a transmission unit for driving the separator of FIGS. 13 to 16.

DESCRIPTION OF THE PREFERRED EMBODIMENT(S)

For the sake of brevity, when describing the apparatus of the present invention, whenever possible the method of using such apparatus will also be described.

Figure 1:
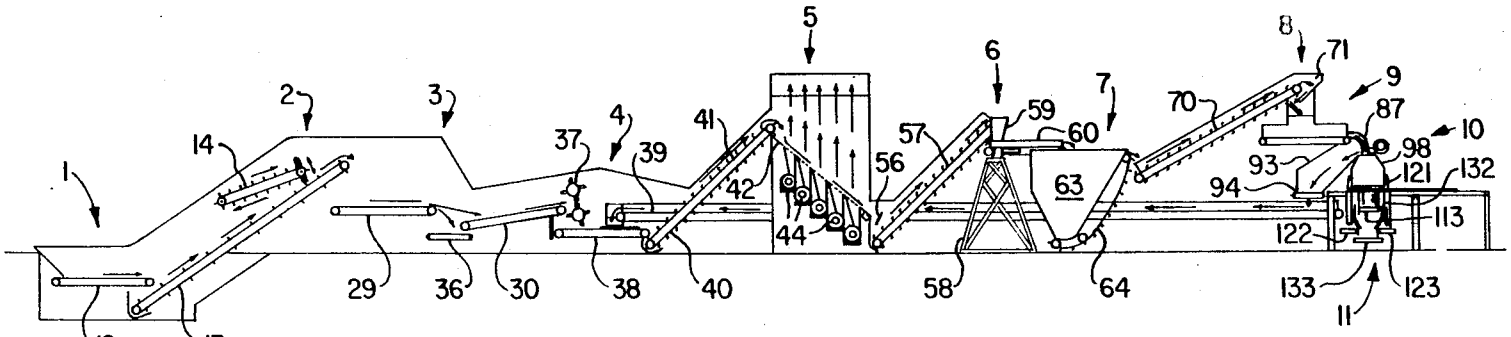
FIG. 1 is a partly sectioned, side elevation view of a sugar cane processing apparatus in accordance with the present invention.

With reference to the drawings, and in particular to FIG. 1, the apparatus of the present invention includes eleven basic sections, generally indicated by the numbers 1 to 11 in FIG. 1. The sections include an inlet or input section 1, where sugar cane is introduced into the apparatus. Following introduction into the apparatus, the stalks of sugar cane are fed through a feed control section 2, which meters the quantity of cane being fed to successive sections of the apparatus. The cane discharged from the feed control section 2 passes through an aligning and first cleaning section 3, where at least some of the foreign matter in the cane is removed, and the stalks are thinned out prior to being fed into a cutting or billetting section 4. After cutting, the stalks are fed into a cleaning tower 5 for air, and magnetic cleaning. The cleaned billets then pass through a distributing chute and rotating swing conveyor 6 to a distributing hopper 7. From the hopper 7, the billets pass through surge eliminating chutes 8 to billet aligner and delivery units 9. The units 9 deliver the billets to separators 10, where the epidermis rind and core are separated, and discharged via discharge section 11.

Figure 2:
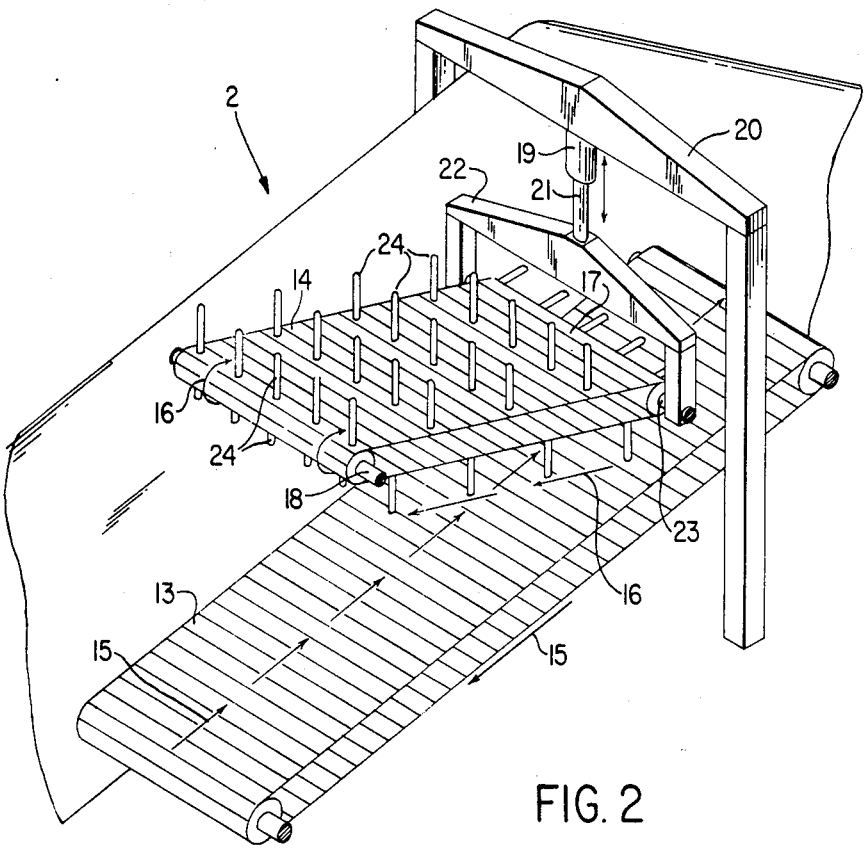
FIG. 2 is a perspective view of input control conveyors used in the apparatus of FIG. 1.

Referring to FIGS. 1 and 2, whole sugar cane stalks are dumped onto a conventional, horizontal cane conveyor 12. Using stop-start control of the conveyor 12, the cane stalks are fed in controlled quantities to an inclined cane conveyor 13. The conveyor 13 is operated by a variable speed control (not shown), and normally moves faster than the preceding conveyor 12. The effect is to remove reasonably uniform quantities of cane from the mass of cane stalks piled on the first conveyor. The conveyors 12 and 13 are controlled by an operator at the inlet end of the apparatus. Metering of the cane stalks in a layer of uniform thickness from the conveyor 13 is effected using a comb back conveyor 14, which is located above the conveyor 13. As illustrated by arrows 15 and 16 in FIG. 2, the conveyor 14 is intended to travel in a direction opposite to the direction of travel of the conveyor 13 and the cane stalks. The end 17 of the conveyor 14 closest to the inclined conveyor 13 can be rotated around a horizontal axis defined by the roller shaft 18 at the other end of the conveyor 14. Vertical movement of the end 17 of the conveyor 14 is effected by a hydraulic cylinder 18 extending downwardly from a frame 20. A piston rod 21 of the cylinder 19 is connected to the top end of a yoke 22 in which roller shaft 23 is rotatably mounted. Thus, the distance between the conveyors 13 and 14 can be varied for controlling the thickness of the layer of cane passing between the conveyors. A plurality of tines 24 project outwardly from the flights of the conveyor 14 for combing back the cane stalks.

Figure 3:
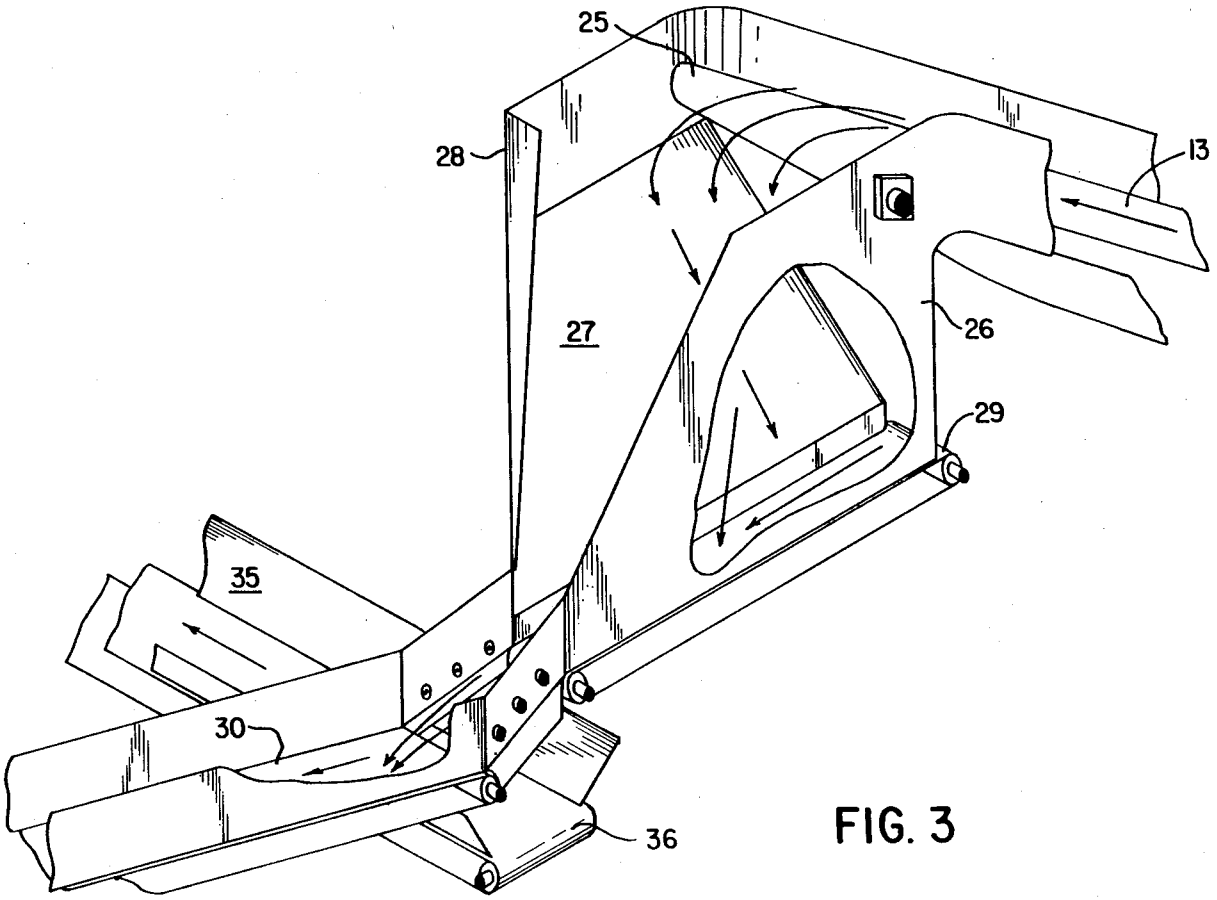
FIG. 3 is a perspective view of the input end of a cane orienting section of the apparatus of FIG. 1.

From top end 25 of the conveyor 13, the cane stalks fall between two walls 26 and 27 of the chute 28 (FIG. 3). The wall 26 is vertical and the other wall 27 is inclined. Thus, any cane stalks tending to bridge the gap between the walls 26 and 27 finds no support on the vertical wall 26, and thus falls onto an alignment conveyor 29 at the bottom of the chute 28. The inclined wall 27 of the chute 28 reduces the width of the cane flow to the width of the conveyor 29. The speed of the conveyor 29 is substantially higher than the speed of the conveyor 13 for thinning out the layer of cane stalks.

Figure 4:
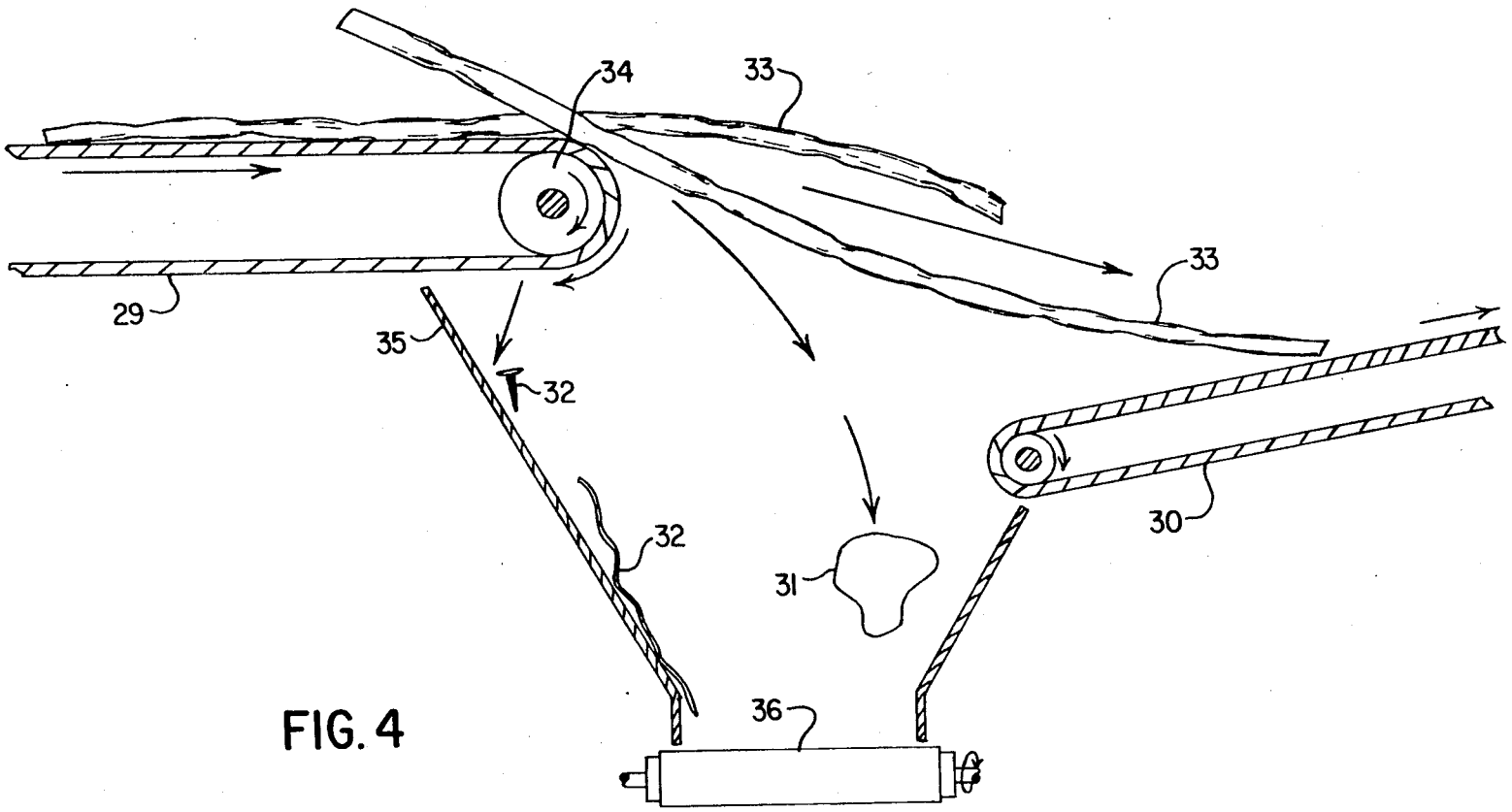
FIG. 4 is a partly sectioned, side elevation view of the cane orienting and initial cleaning section of the apparatus of FIG. 1.

As best shown in FIG. 4, the stalks are fed from conveyor 29 to a slightly upwardly inclined conveyor 30 which is located beyond and slightly below the conveyor 29. Because the cane stalks are aligned in the direction of travel of the conveyors 29 and 30, the stalks may project beyond the end of the conveyor 29 without tipping. Moreover, the momentum of the stalks carries them beyond the end of the conveyor 29 before appreciable tipping occurs. Thus, there can be a gap between the conveyors 29 and 30 for the removal of stones 31 and metallic objects 32 from the cane stalks 33. In order to remove the metallic objects 32, roller 34 at the trailing end of the conveyor 29 is a conventional magnetic belt drive roller. The debris removed from the stalks 33 falls through a downwardly tapering chute 35 onto a conveyor 36 which is normal to the direction of travel of the stalks 33 for suitable disposal.

From the conveyor 30, the cane stalks 33 are fed between the rollers of a conventional twin roller-type cutting or chopping machine 37 (FIG. 1), where the stalks are chopped into billets of a predetermined maximum length. Such length is determined by the speed of cane flow, the number of blades on the chopper rollers, and the speed of rotation of the latter. The cane billets thus produced are fed to a horizontal conveyor 38. The conveyor 38 also receives trash and rejected cane from a return conveyor 39, which is described in greater detail hereinafter. The conveyor 38 is also the receiving conveyor for cane already chopped by cane harvesters (not shown).

Figure 5:
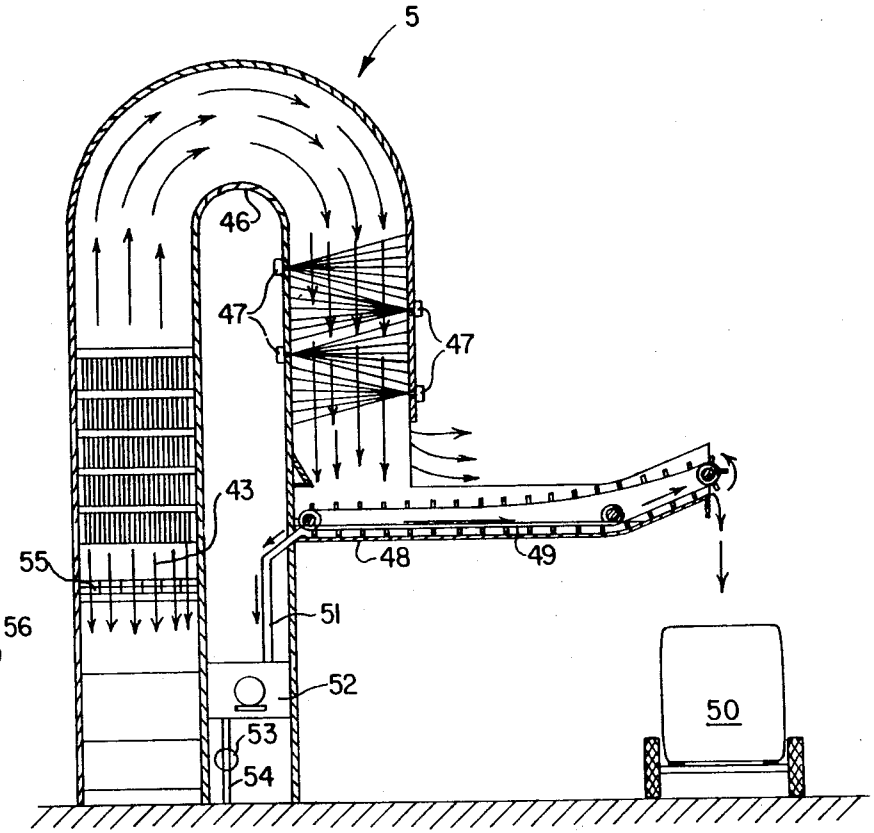
FIG. 5 is a sectional view of a cleaning tower for use in the apparatus of FIG. 1.
Figure 6:
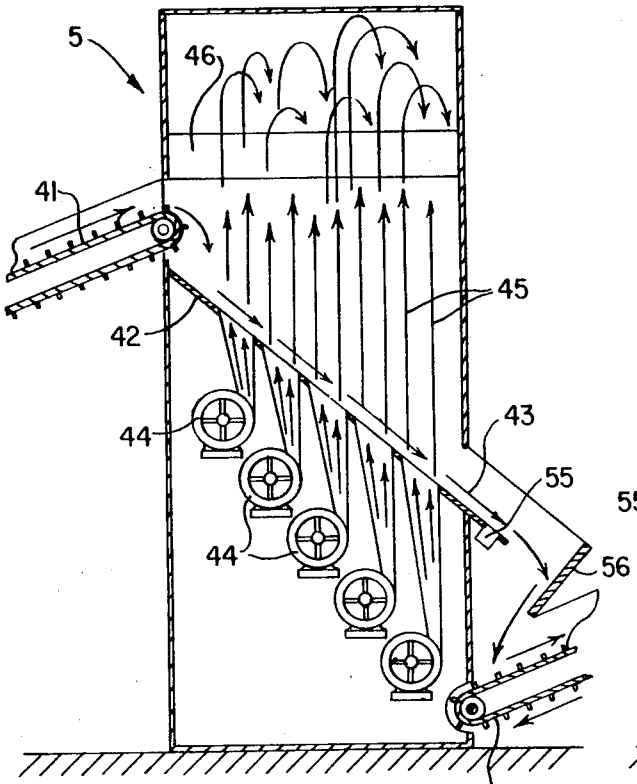
FIG. 6 is a cross-sectional view of the tower of FIG. 5.

From the conveyor 38, the cane billets are fed onto leading end 40 of an inclined conveyor 41, and are delivered into the top end of the detrashing or cleaning tower 5 (FIGS. 1, 5, and 6). The tower 5 contains an inclined, perforated plate 42. Cane billets flow down the plate 42 in the direction of arrows 43. During such downward movement, air from blowers 44 goes upwardly through the plate 42 and the cane billets in the direction of arrows 45. As best illustrated in FIG. 5, air flowing upwardly through the plate 42 and the billets removes trash and dust from the descending billets, and passes upwardly over a central divider 46. The speed of the air is such that the cane billets tumble and float down the plate 42 on a cushion of air. Of course, the force of the air is not sufficient to remove cane billets with the debris. The air ladened with trash and dust passes over the divider 46 and descends between spray nozzles 47, which project a fine spray of water across the path of the air. The water wets the dust and debris to prevent discharge of such material into the atmosphere, and helps to create a downdraft by cooling the air. The downdraft reduces the back pressure of the air, and thus reduces the possibility of dust and debris leaving the tower via the cane billet inlet and discharge openings. The wet dust and debris falls into a trough 48. A drag chain-type conveyor 49 in the trough 48 removes debris for disposal, i.e., to a truck 50. The water collected by the trough 48 is recirculated into the cleaning section of the tower through a duct 51, and a pump and filter unit 52. The water pressure in the unit 52 is maintained by introducing water through line 53 and valve 54.

Billets reaching the bottom end of the plate 42 pass over permanent magnets 55, which are disposed in a line transverse to the path of travel of the billets. The magnets remove any iron objects left in the cane. The cane billets are then deflected by an inclined plate 56 onto the leading, bottom end of an inclined conveyor 57. The plate 56 reduces the speed of travel of the billets, and tends to eliminate surges in the quantity of cane flow.

Figure 7:
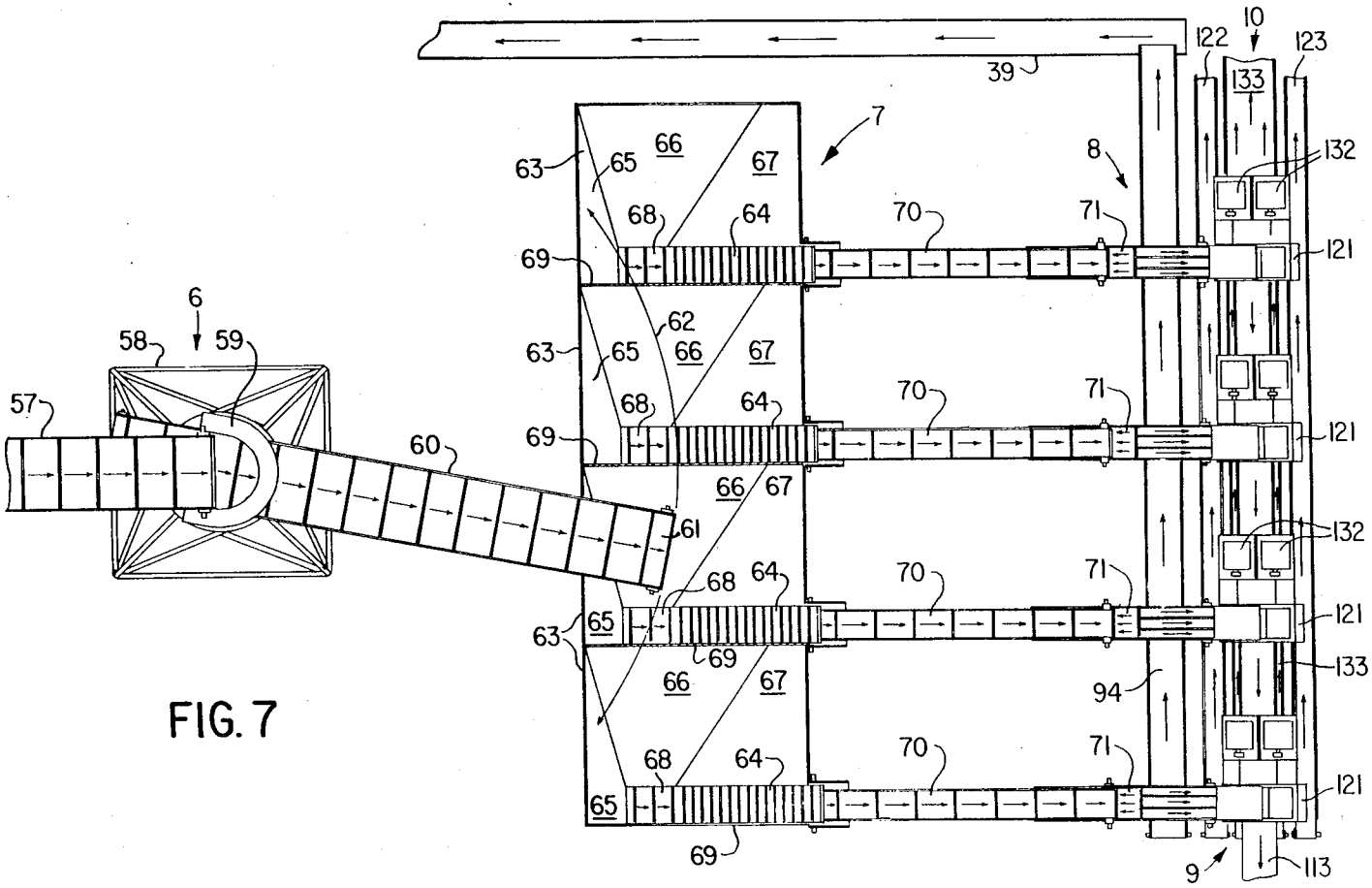
FIG. 7 is a plan view of the trailing end of the apparatus of FIG. 1.

The conveyor 57 delivers the cane billets to the distributing chute and swing conveyor 6 (FIGS. 1 and 7). The chute and swing conveyor 6 are mounted on a tower 58, and include a chute 59 for delivering the billets to the leading end of a horizontal swing conveyor 60. The conveyor is pivotally mounted on the tower 58 for rotation around a vertical axis, so that the discharge or trailing end 61 of the conveyor can be rotated through a large arc 62 for distributing cane billets to any of a plurality of sections 63 of the distributing hopper 7. The conveyor 60 can be set in one position or travel in a smaller arc, depending on the number of separators 10 in use. The hopper 7 is designed to meter, i.e., feed predetermined amounts of cane billets to the separators 10. As mentioned hereinbefore, with hoppers having V-shaped bottoms, it is possible for the drag chain conveyor used to extract the cane billets from the hopper to form a tunnel through the cane which results in the reduction or cessation of cane flow from the hopper. Such tunnelling is prevented in the present case by the use of a drag chain conveyor 64 in each section 63 of the hopper, which conveyor moves horizontally under the billets before rising to the top of the hopper. Moreover, the three surfaces 65, 66, and 67 defining the sides and bottom of the hopper sections 63 are inclined towards the horizontal portion 68 of the conveyor 64. The fourth side 69 of each hopper section 63 is vertical to prevent cane billets bridging over the conveyor 64.

The hopper drag chain conveyors 64 include spaced apart flights, whereby only a predetermined quantity of cane billets are delivered from each section of the hopper. By varying the speed of the conveyors 64, the quantity of billets fed to the separators 10 can be accurately controlled. The conveyors 64 deliver the billets to inclined conveyors 70 which feed the billets into surge elimination chutes 8 (FIG. 9). Each surge elimination chute 8 includes a casing 71 containing a pair of inclined surfaces 72 and 73. Billets entering the surge elimination chutes 8 slide down the surface 72 cascading against the surface 73. The result is an even flow of cane billets. The flow of billets is rendered uneven by the hopper drag chain conveyors 64, which dump the cane billets in heaps onto the conveyors 70. A bank of permanent magnets 74 is provided at the trailing end of the chute 72 as added protection against iron objects being fed into the separators 10.

Figure 8:
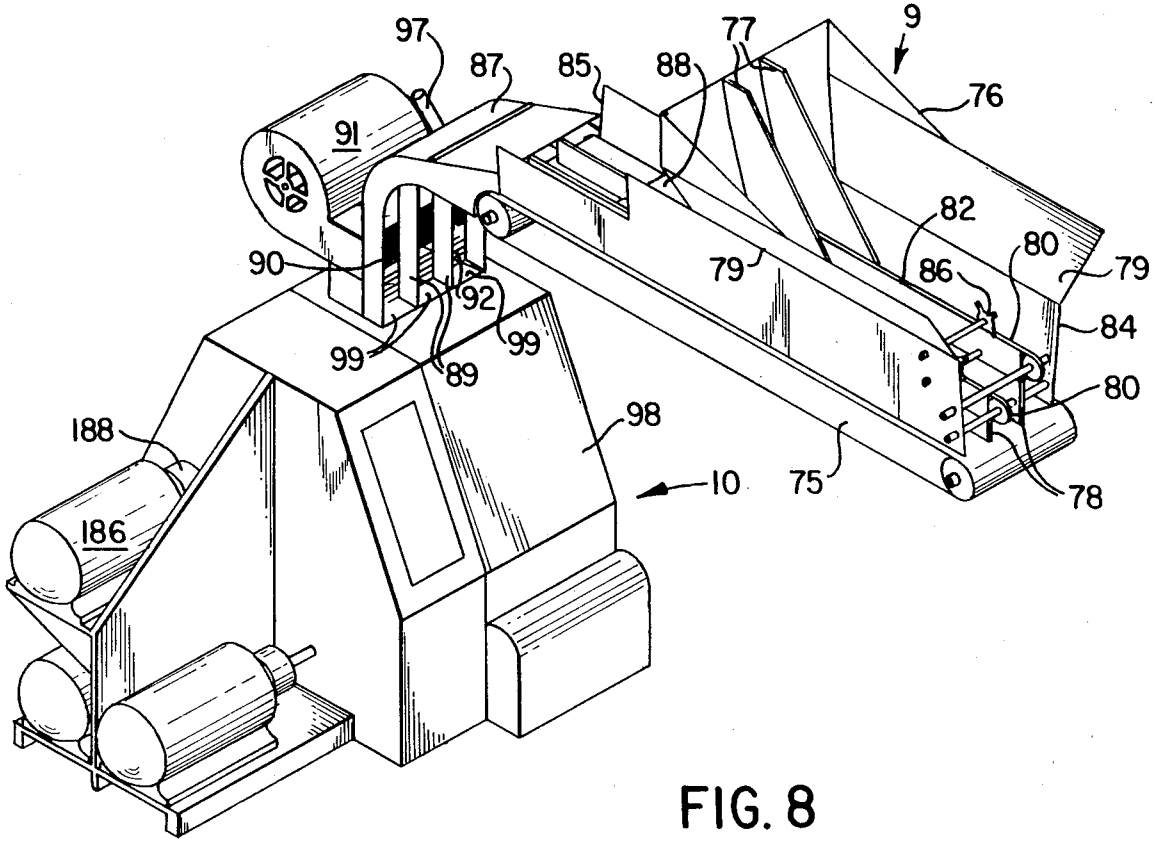
FIG. 8 is a perspective view from above and the leading or input end of a billet aligner and separator for use in the apparatus of FIG. 1.
Figure 12:
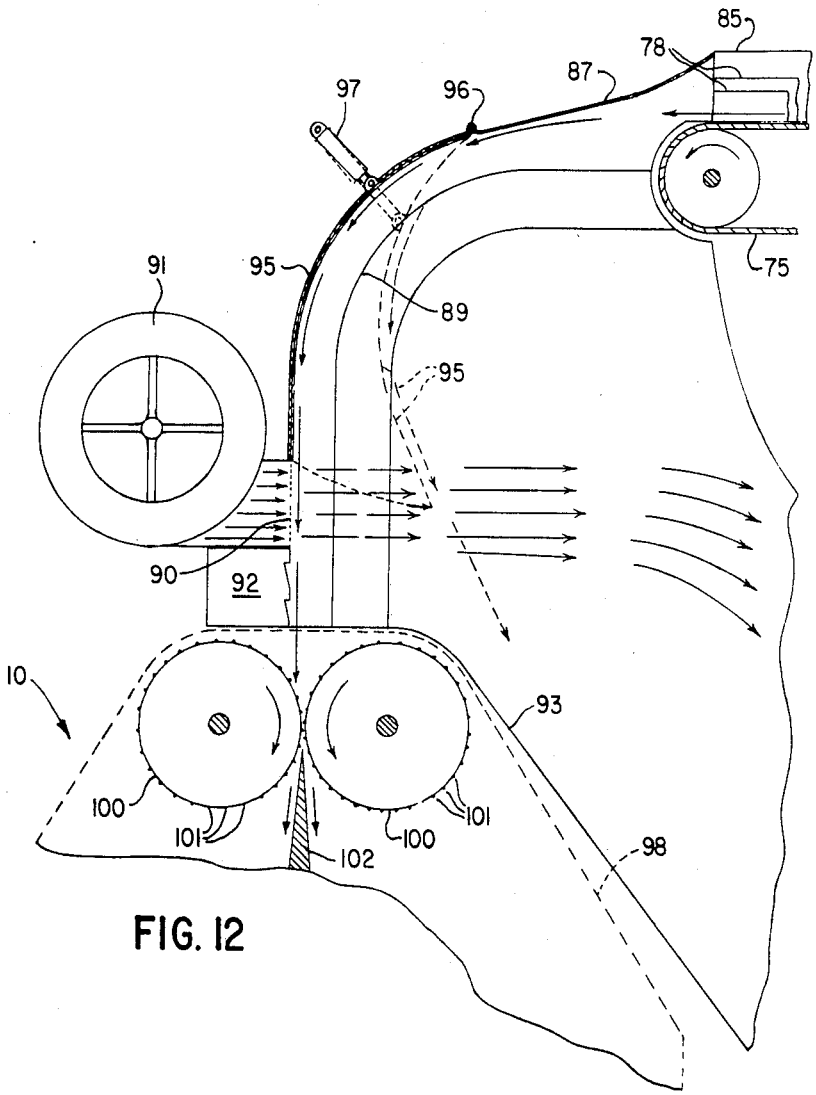
FIG. 12 is a longitudinal sectional view of the upper input of the separator of FIG. 8.

Billets passing through the chutes 8 are fed into billet aligners and delivery units 9 (FIGS. 1 and 9 to 11). The units 9 are designed to align billets longitudinally in the direction of travel of an aligner conveyor belt 75 in the bottom of each casing 76 of the units 9. This is accomplished by allowing the cane billets to land on or between the partitions 77. The partitions 77 slope downwardly to meet a set of horizontal partitions 78. As the cane billets land on the sloped down partitions, a portion of them will tumble down to land on the horizontal partitions 78. This is done to increase the area where the cane billets land and therefore the capacity of the aligner unit. The horizontal partitions 78 and sides 79 of the aligner are inclined, converging downwardly, so that the gaps between them immediately above the conveyor 75 is much less than the average length of the billets. Thus, any billet falling between the partitions 77 will assume a position roughly parallel to the partitions 78 and sides 79 in line with the desired direction of flow. The heights of the partitions 78 differ from each other so that any cane billets landing across a pair of partitions will tend to tip and fall between the partitions. To further ensure that the cane billets do not remain lying across the horizontal partitions, the top of each partition 78 is covered by a moving, double "V" belt 80, running in a track 81 which is mounted in a bracket 82 on the top of the partition 78. The tension on the belts 80 can be adjusted by brackets 83 at the trailing end of the belts. The belts 80 are driven from the leading end, so that the belts move in a direction opposite to the flow of the cane flow, and at different speeds. The different speeds of the double "V" belts 80 will cause one end of any billet lying across a pair of partitions to travel faster than the other end, thereby moving the billet into alignment with the space between the partitions, eventually causing the billet to fall to the surface of the conveyor belt 75. By moving belts 80 in a direction opposite to the flow to the conveyor 75, any billets lying across or hung up on the belts 80 will be moved out of the flow area, thus reducing any chance of an accumulation of billets on top of the partitions 78. Some cane billets, not quite chopped through, will tend to loop over a partition 78 and impede cane flow. The belts 80 will also remove such billets. Upon reaching end 84 of the aligner opposite billet discharge 85, such looped over billets are chopped free by revolving knives 86, located close to one side of the belt 80. After being chopped free, the billets drop onto the conveyor 75 and are taken back into the cane flow. Upon hitting the conveyor 75, some billets will somersault down the surface of the conveyor and may cause jamming at cane delivery chute 87 (FIGS. 1, 8, and 12). In order to prevent such jamming, strips 88 of flexible material are provided between the partitions 78 and sides 79 of the aligner. The strips 88 are secured above the surface of the conveyor 75 with the bottom end lying on the surface of the conveyor 75. The flexible damper strips 88 are situated immediately downstream from the trailing ends of the belts 80. The effect of the flexible strips 88 is to stop any billets from somersaulting and smooth any overlapping billets into a single layer. From the cane billet aligner unit 9, the aligned cane billets are propelled from the end of the fast moving aligner conveyor 75 onto the inside surface of the downwardly curving chute 87. The chute 87 changes the direction of flow of the billets from the horizontal to the vertical. The interior of the chute 87 is divided by parallel partitions 89 (FIGS. 8 and 12), aligned with the partitions 78 of the cane aligner unit 9. The partitions 89 ensure that the billets are kept approximately aligned in the direction of flow since perfect alignment is not crucial. The cane billets will be processed by a separator 10 misaligned, without affecting the separation. The vertical portion of the chute 87 includes perforations 90, so that air from a blower 91 can pass through the chute. The air gives the passing billets a final detrashing, removing any leaf material, dust, etc., knocked loose in that portion of the apparatus following the tower 5. The speed of the air is kept low enough not to divert the billets from their line of flow. Immediately below the detrashing section of the chute 87, the billets move past a bank 92 of permanent magnets. The magnets 92 are situated in this position to give maximum protection to the separator 10 against any iron items being introduced. The debris removed by the air from the blower 91 is carried away by a chute 93 to a conveyor 94, and then to return feed conveyor 39 mentioned hereinbefore. Thus, the debris returns to the tower 5. As well as disposing of the trash, the return conveyor system returns odd billets which are sometimes ejected at the entrance to the separator 10. Should a power failure occur, or a mechanical problem develop in the separator 10, or in the system from the separator, cane jamming would develop very rapidly. To avoid such a condition, plates 95 are provided in the interior curved section of the chute 87. The plates 95 are pivoted at their upper ends on pins 96. The plates 95 extend downwardly to the perforations 90. The plates 95 are actuated by means of a ram 97 which moves the plates away from the normal direction of cane flow into the separator 10, and directs the cane flow into the trash disposal chute 93, and thence back to the tower 5 for recirculation into the supply system to the cane separators 10. The ram 97 may be actuated automatically by any overload condition after the feed chute 87 of the type caused by a power failure or mechanical problem, or can be operated manually by the operator.

Figure 13:
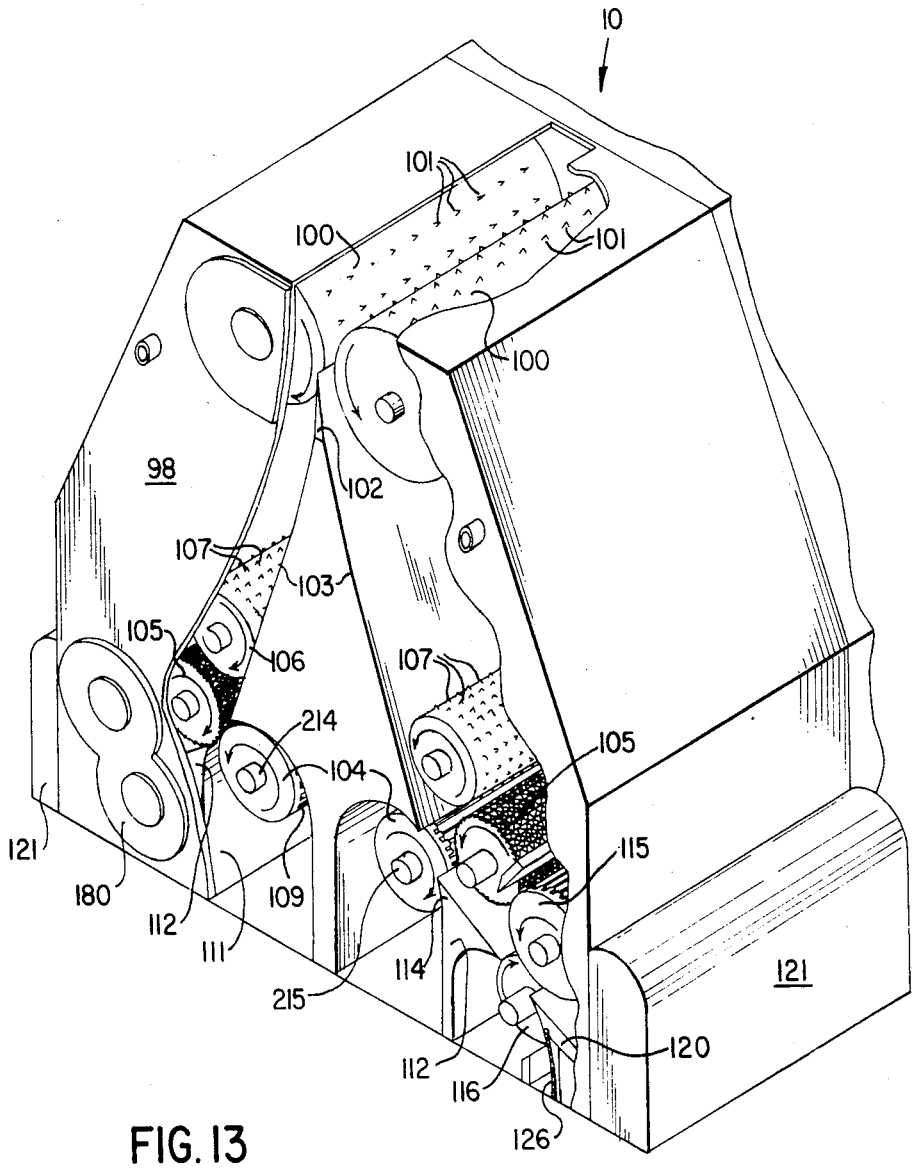
FIG. 13 is a perspective, partly sectioned view of the separator of FIG. 8 from one end and above.

The vertically aligned billets from the chute 87 enter casing 98 of the separator 10 through an inlet opening 99. The billets are then gripped by a pair of spaced apart feed drums 100 (FIGS. 12 and 13). The drums 100 are formed of a flexible material and include peripheral surfaces with spikes 101 projecting very slightly above the surfaces of the drums. The spikes 101 ensure a positive grip on the rind portion of the cane billets. The rotating feed drums 100 drive the billets onto the sharp edge of a splitter blade 102. Once the splitting process has started on a billet, the diverging surfaces of the blade 102 force the parts of the billet apart and complete the splitting process. The two pieces of cane billet are then diverted by two diverging slide plates 103 to close to the gap between core removal or milling drums 104 and core milling feed drums 105. Because the core milling and feed drums will not grip anything but below average thickness of split cane billets, a positive feed is obtained by a feed drum 106, which has a flexible surface with spikes 107 projecting very slightly above the surface thereof. The spikes 107 engage the surface of the rind. The drum 106 is positioned above the surface of a slide plate 103 and close to the trailing end thereof. There is a gap between each plate 103 and drum 106 so that the cane is gripped by the flexible surface and the spikes 107 of the drum. The feed drum 106 drives the cane halves into the nip of the core removal and feed drums 104 and 105, respectively. Another reason for employing the feed drum 106 is that any small pieces of cane arriving at the gap between the drums 104 and 105 will bounce around in the area of the gap and, if permitted, will cause a build-up. With positive feed of the split cane halves, the ends of the halves drive the small pieces into the gaps, avoiding jamming of cane in this area. As the cane halves feed through the fixed gap between the drums 104 and 105, the cane stalk is gripped by the teeth of the feed drum 105 and because the stalk is flattened at the gap, milling drum blades 109 remove the softer core of the cane from the relatively hard fibres of the rind. The milled pieces of core material are ejected down surface 111 of a deflector 112 onto a core receiving conveyor 113 (FIGS. 1 and 7). Meanwhile, the rind strips are deflected by the edge 114 of the deflector 112, and are guided by the deflector 112 into a gap between an epidermis milling drum 115 (FIGS. 13 and 14) and an epidermis milling feed drum 116. Epidermis milling feed drum teeth 117 grip the core side of the rind strip while blades of the rotating milling drum 115 strip the wax and epidermis material in the direction of arrows 119. Such material is ejected over the top of a rind deflector 120 through a delivery chute 121 and onto wax/epidermis receiving conveyors 122 and 123. Meanwhile, the rind strip 125 is deflected downwardly out of the line of flow of the epidermis material by the deflector 120. In order to guide the rind strips 125 in the desired direction, as may be required by different installations, or width of conveyors, the deflector 120 includes adjustable plate 126. The plate 126 is pivotally mounted at the leading end thereof on a pin 127, and can be locked in position by a bolt 128, which connects a bracket 129 to an attachment plate 130. The bracket 129 includes an arcuate slot 131 so that the position of the plate 126 can be adjusted. The rind passing the deflector 120 and plate 126 is fed through ducts 132 to a conveyor 133 for discharge from the apparatus.

The core milling drums 104 are structurally similar to the epidermis milling drum 115. Accordingly, only one drum 104 will be described in detail, it being understood that the same description applies to the other milling drums.

With any type of drum requiring the removal of blades for replacement or sharpening purposes and with the requirement that the blades be replaced to an exact drum diameter concentric to the axis of rotation, it is normal to reinstall the blades using jigs and/or measuring devices. Moreover, a trained technician is required to carry out this type of work. The use of jigs or other instruments and a technician also introduces the possibility of errors in the installation of the blades. Jigs, measuring instruments and/or skilled personnel are not required with the milling drums of the present invention. Blades can be installed quickly. Moreover, lengths and heights may vary slightly, the drum balance being the determining factor for the amount of blade variation, without affecting the correct installation of the blades. By presetting the drum diameter to the diameter required for each drum installation, the apparatus may be designed so that the drum shaft or bearings need not be adjustable to set the milling blades at a required distance from another part of the machine, such as another drum. Thus, it is possible to enclose completely all drives for lubrication, cleanliness and safety. Moreover, no skill is required for adjusting shafts or other parts of the apparatus.

The milling drum 104 (FIGS. 15 to 26) includes an elongated, cylindrical body 135. Slots 136 extending along the length of the body 135 receive and retain the milling blades 109. In the drum, narrow additional slots 137 are provided between pairs of blade slots 136, so that sides 138 of the slots 136 can flex away from and against the blades 109 to secure the blades firmly in position, without any movement under load. The springing of the metal sides 138 is accomplished by providing threaded holes spaced apart along the length of the narrow slots 137. The holes may be of two types, namely holes 139 (FIGS. 17 and 19) with a tapered thread, so that when set screws 140 are tightened into the hole 139, the metal sides 138 are forced apart to grip the sides of a pair of the blades 109. Alternatively, holes 141 (FIGS. 17 and 20) can be threaded normally for receiving slot expansion screws 142, which have heads 143. The screw 142 is screwed into the upper end of the hole 141 which is also tapered. Thus, by wedging action, the sides 138 are forced apart to grip the sides of the milling blades 109. The blades 109 are positioned concentrically and adjusted to the desired drum diameter by drum end plates 144 and 145. Each end plate 144 (FIGS. 15, 21, 22, and 24) and 145 (FIGS. 15, 23, and 24) is designed so that when the inner corner of each blade 109 contacts an inclined annular surface 146, the blade 109 slides outwardly on such surface until the other corner of the blade meets the inner surface of a tooth 147. The inside diameter of each end plate 144 and 145 at the teeth 147 is exactly that required for the particular drum 104, and the teeth 147 are concentric with the axis of rotation of shaft 148. The slots 150 between the teeth 147 permit the escape of material which would be trapped by an uninterrupted annular flange. The teeth 147 are also a safety feature, because they form a positive stop, preventing any blade 109 leaving a slot 136 under the centrifugal load imposed on the blade by rotation of the drum 104. The end plates 144 and 145 are located on the ends of the body 135 by dowel pins 151 (FIG. 16) in holes 152 (FIGS. 21 and 23). The end plates are secured to the body by screws 153 passing through holes 154 in the plates. The end plates 144 and 145 are provided with threaded holes 155, which are used for the plate extraction bolts (not shown). When the bolts are screwed into the plate 144 or 145, they bear against the body of the drum and with continued screwing, force the plate away from the drum body 135. The front end plate 145 is designed so that screws 156, when screwed into holes 157 in the end plate, contact the inner corner of the blades 109. Because the screws are at an angle of approximately 45° with respect to one end 158 of the blades, they force the blade in two directions, namely along the slot 136 and outwardly towards the inner surface of tooth 147 on the rear end plate 144. When the other end 159 of each blade 109 comes to a stop in the rear end plate 144, the screw 156 then forces the other corner of the front end 158 of the blade against the inner surface of the tooth 147, locking the blade 109 in the operating position. Thus, positioned blades 109 are then clamped tight in their slots 136 by tightening the slot expanding screws 140 or 142.

The drums are centered on the separator shafts by using one piece rear cones and segmented front cones. A rear cone 161 (FIGS. 24 and 26) is assembled on drum shaft 148 and is prevented from turning on the shaft by a locking key 162. The tapered surface 163 of the cone 161 bears against the tapered surface 164 of the drum body 135 (FIG. 24), which is prevented from rotating on the cone surface by a locking key 165 on the cone for engaging locking keyway 166 (FIGS. 14, 21, and 22) of the drum, and the rear end plate 144. A front segmented cone 168 is defined by two segments 169 with an annular groove 170. The groove 170 allows the segments to be placed over an annular flange 171 of a drum retaining nut 172 prior to the nut 172 being tightened on the shaft 148. Upon tightening the retaining nut 172, the annular flange 171 of the nut engages annular surface 173 of the split cone 168 to force the segments against inner, tapered surface 174 of the drum body 135. This centers and locks the drum in the operating position. Upon removal of the drum 104, the retaining nut 172 is backed off from the inner surface 173 of the cone 168, and the flange 171 of the nut engages flange 175 of the cone 168 for removing the cone from the drum.

The ends 176 of the drum shafts 148 are supported by bearings 177 and are retained in bearing housing 178 by a bearing retaining and mounting plate 179. The retaining plate 179 complete with housing 178 and bearing 177 is connected to a tail end bearing and housing assembly mounting plate 180 (FIGS. 13 and 24) by bolts 181. The mounting plates 180 are designed to mount a pair of bearing housing assemblies belonging to drums that are paired on the cane separator machine, such as the cane core remover feed drum 105 and the cane core removal drum 104. This ensures that the same bearing and mounting plate assemblies are mated with the same shafts each time. Thus, any problems of bearing misalignment which could occur with single housing assemblies being reassembled on different shafts is obviated. All of the bearing housing plates and housing mounting plates are dowelled to ensure accuracy of location in a manner similar to the dowel pins 151 on the milling drum assemblies (FIG. 16).

The ends 176 of the drum shafts 148 are threaded internally at 183 for attachment of a drum removal device (not shown) which permits removal of the drums from the apparatus without the use of lifting tackle.

Referring now to FIG. 27, the power transmission section of each separator 10 is designed so that all shafts have fixed locations, and all drives are totally enclosed. Thus, chain drives may be used. The chain drives can have a sufficient supply of lubrication in the transmission casing 185 and can be kept free from the damaging effects of dust and debris.

The input drive for the low speed feed drum system is supplied by a motor 186 (FIG. 8), or by a steam turbine (not shown) through a gearbox (not shown). The power is transmitted to the input shaft 187 through a transmission unit 188 (FIG. 8), such as a standard type of torque limiter, fluid drive clutch or flexible coupling. A suitable chain sprocket 189 or 190 is provided on the input shaft 187 for variations in speed caused by the power source, such as is the case with an electric motor running on a 50 hertz current as compared to a motor running on a 60 hertz current. In such case, there is an approximate difference of one-fifth between the revolutions per minute as required by the electrical current cycles per minute. From the input shaft 187, the power is transmitted to idler shaft 191 by a chain 192. A chain 194, from the idler shaft 191 transmits power to right hand splitter slide drum shaft 195. From the shaft 195, power is transmitted by a chain 196 to right hand splitter feed drum shaft 197. Also from shaft 195 a chain 198 transmits power to the core milling drum feed shaft 199 and to the epidermis milling feed drum shaft 200. By means of a pair of gears 201 and 202 power is transmitted to splitter slide feed drum shaft 203, and, at the same time, the direction of rotation of this shaft is reversed by the gears 201 and 202. From the shaft 203, power is transmitted by chain drive 206 to the core milling feed drum shaft 207 and to the epidermis milling feed drum shaft 208. Power is transmitted by chain 209 from the epidermis feed drum shaft 200 to an oil lubrication pump 211. The pump 211 supplies oil through the spray nozzles 212 for lubrication of the high speed chain drives between the core milling and epidermis milling drum shafts. The remainder of the drives and bearings are lubricated by oil mist and splash from the sump of the power transmission section. The oil level 213 is sufficient for the lower chain drive sprockets to be partially immersed in the oil, thus supplying the oil splash and mist for lubrication. Because of the highly fluctuating loads on the core milling drum shafts 214 and 215 (FIGS. 13 and 27), flywheels 216 and 217 are provided on the shafts to even out loading, and reduce power requirements and strain on the drives, and, in the case of an electric motor power source avoiding high, undesirable electric current surges. The flywheels 216 and 217 are also mounted inside the power transmission section. Flywheels are not required for the epidermis milling drum shafts 210 and 218 since the drums themselves have a sufficient flywheel effect for the far lighter fluctuating loads of such drums compared to those on the core milling drums. The chains 219 and 220 provide drive from the core milling drum shafts 214 and 215 to the epidermis milling drum shafts 218 and 210, respectively.

What is claimed is:

1. A milling drum comprising an elongated cylindrical body, a plurality of blade receiving slots formed in and extending longitudinally of said body for receiving milling blades, a milling blade positioned in each of said blade receiving slots, an additional slot formed in said body between each adjacent pair of said blade receiving slots, whereby the sides of said blade receiving slots may be flexed toward and away from each other for releasably securing said milling blades therein, means in said additional slots for causing said flexing of said sides for gripping said blades and securing said blades in said blade receiving slots, end plates for accurately positioning said blades in said body; said end plates including teeth extending longitudinally along a portion of said body and along the radially outermost edges of said blades when said end plates are in position on the ends of said body; said end plates further including an inclined annular hub adjacent the inner edge of said teeth, whereby when the radially outermost edges of said blades contact said inclined hub, said blades are forced against said teeth to accurately position said blades.

2. A milling drum as in claim 1 and including threaded holes in said additional slots; and said means for causing said flexing of said sides comprising screw means for forcing the sides of the milling blade receiving slots together.

3. A milling drum as in claim 1, including screws in said inclinded annular hub for engaging said blades for forcing said blades outwardly against said teeth.

4. A milling drum as in claim 3 including a shaft for receiving said drum; and cone means in each end of said drum for centering said drum on said shaft.

* * * * *